US007604330B2

(12) United States Patent
Enomoto et al.

(10) Patent No.: US 7,604,330 B2
(45) Date of Patent: Oct. 20, 2009

(54) LIQUID EJECTION HEAD, IMAGE FORMING APPARATUS AND METHOD OF MANUFACTURING LIQUID EJECTION HEAD

(75) Inventors: Katsumi Enomoto, Kanagawa (JP); Yasuhiko Maeda, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 347 days.

(21) Appl. No.: 11/369,772

(22) Filed: Mar. 8, 2006

(65) Prior Publication Data

US 2006/0203044 A1 Sep. 14, 2006

(30) Foreign Application Priority Data

Mar. 9, 2005 (JP) ..... 2005-065974

(51) Int. Cl.
*B41J 2/045* (2006.01)
*B41J 2/14* (2006.01)

(52) U.S. Cl. ..... 347/71; 347/50

(58) Field of Classification Search ..... 347/68–72, 347/50, 58

See application file for complete search history.

(56) References Cited

U.S. PATENT DOCUMENTS 5,289,209 A * 2/1994 Suzuki et al. ..... 347/71
5,475,279 A 12/1995 Takeuchi et al.
5,643,379 A 7/1997 Takeuchi et al.
5,933,170 A 8/1999 Takeuchi et al.
6,270,203 B1 8/2001 Kitahara et al.
6,290,340 B1 9/2001 Kitahara et al.
6,601,949 B1 8/2003 Kitahara
6,929,354 B2 8/2005 Kitahara

FOREIGN PATENT DOCUMENTS

JP 6-234218 A 8/1994
JP 2000-108342 A 4/2000
JP 2001-353866 A 12/2001

OTHER PUBLICATIONS

US 6,120,137, 09/2000, Kitahara et al. (withdrawn)

* cited by examiner

*Primary Examiner*—Stephen D Meier
*Assistant Examiner*—Geoffrey Mruk
(74) *Attorney, Agent, or Firm*—Birch, Stewart, Kolasch & Birch, LLP

(57) ABSTRACT

A liquid ejection head having a plurality of ejection ports which eject liquid, a plurality of pressure chambers which are connected respectively to the ejection ports, a plurality of piezoelectric elements which are disposed on a side of the pressure chambers reverse to a side adjacent to the ejection ports and respectively deform the pressure chambers, and a laminated body which is disposed on the side of the pressure chambers reverse to the side adjacent to the ejection ports and includes a plurality of ceramic thin plates arranged to overlap each other. The laminated body is formed with a common liquid chamber which supplies the liquid to the pressure chambers, and electrical wires which supply drive signals to the piezoelectric elements and are formed so as to rise upward in a direction substantially perpendicular to a surface on which the piezoelectric elements are disposed.

12 Claims, 9 Drawing Sheets

LIQUID EJECTION HEAD, IMAGE FORMING APPARATUS AND METHOD OF MANUFACTURING LIQUID EJECTION HEAD

BACKGROUND OF THE INVENTION

1. Field of the Invention

The present invention relates to a liquid ejection head, an image forming apparatus and a method of manufacturing a liquid ejection head, and more particularly, a liquid ejection head having a structure in which a plurality of plate members are arranged to overlap each other.

2. Description of the Related Art

There is known, as an image forming apparatus, an inkjet recording apparatus which comprises a print head (liquid ejection head) having an arrangement of a plurality of nozzles (ejection ports) and which forms images on a recording medium by ejecting ink droplets from the nozzles toward the recording medium while causing the print head and the recording medium to move relatively to each other.

A print head of an inkjet recording apparatus of this kind comprises, for example, a common liquid chamber which accumulates ink to be supplied to the ink tank, pressure chambers to which ink is supplied from the common liquid chamber through ink supply ports, a diaphragm constituting one wall of the pressure chambers, piezoelectric elements provided on the diaphragm at positions corresponding to the pressure chambers, and nozzles connected to the pressure chambers. When a piezoelectric element is driven by applying an electric signal corresponding to the image data, in a state where the pressure chamber is filled with ink, then the volume of the pressure chamber is decreased by the deformation of the diaphragm, and the ink inside the pressure chamber is ejected from the nozzles in the form of an ink droplet, thereby forming a dot on the recording medium. By combining dots of this kind, an image is formed on the recording medium.

In recent years, it has become desirable to form images of high quality on a par with photographic prints, in inkjet recording apparatuses of this kind. To achieve this, it is necessary to reduce the size of the ink droplets ejected from the nozzles by reducing the nozzle size, as well as increasing the number of pixels per unit surface area by arranging the nozzles at high density. Furthermore, together with the increase in image quality, there have also been demands for improved printing speed, and therefore, it is important to improve ink supply performance (refilling performance) from the common liquid chamber to the pressure chambers, in such a manner that high-frequency driving of the nozzles and ejection of high-viscosity ink can be achieved.

In order to improve productivity and reliability in a print head, various proposals have been made for manufacturing a print head using ceramic (see Japanese Patent Application Publication Nos. 6-234218, 2001-353866 and 2000-108342.) In Japanese Patent Application Publication No. 6-234218, a pressure generation units for generating pressure for projecting ink droplets is constituted by integrated sintering of ceramic, in such a manner that liquid sealing characteristics can be ensured in a reliable manner. However, a composition is adopted in which the individual electrodes of piezoelectric elements (drive signal application electrodes) are extracted to external wires at the end sections of the diaphragm, in such a manner that they pass over the surface of the diaphragm which is made of ceramic, and hence there are limitations on the installation of high-density wiring and this composition is not suitable for achieving high nozzle density.

In Japanese Patent Application Publication No. 2001-353866, flow channels, such as a common liquid chamber and pressure chambers (pressurization liquid chambers) are fabricated by performing sandblasting or dry-etching in glass or ceramic, and therefore it is possible to fabricate a print head by using inexpensive materials, by means of a relatively simple process. However, extraction electrodes are provided in the same plane as individual electrodes provided opposing the diaphragm at a uniform interval from same, and therefore, similarly to Japanese Patent Application Publication No. 6-234218, there are limitations on the installation of high-density wiring. Moreover, the manufacturing process is complicated and expensive.

In Japanese Patent Application Publication No. 2000-108342, pressure generating chamber units made of silicon and flow channel units made of ceramic are bonded together without using adhesive, in such a manner that the manufacturing process of a print head is simplified and reliability can be improved. However, there is absolutely no description of the composition of the wiring for connecting the individual electrodes and the common electrode of the piezoelectric elements provided on the diaphragm at positions corresponding to the pressure chambers, with the drive circuits. For example, if the wires are provided so as to pass over the surface of the diaphragm, as in Japanese Patent Application Publication No. 6-234218, then the wiring space is insufficient and there are restrictions on the installation of high-density wiring. Furthermore, if the common liquid chamber is made large in size, then deterioration of accuracy becomes a concern.

SUMMARY OF THE INVENTION

The present invention has been contrived in view of the foregoing circumstances, an object thereof being to provide a liquid ejection head, an image forming apparatus and a method of manufacturing a liquid ejection head, which enable good refilling performance and high-density wiring installation.

In order to attain the aforementioned object, the present invention is directed to a liquid ejection head, comprising: a plurality of ejection ports which eject liquid; a plurality of pressure chambers which are connected respectively to the ejection ports; a plurality of piezoelectric elements which are disposed on a side of the pressure chambers reverse to a side adjacent to the ejection ports and respectively deform the pressure chambers; and a laminated body which is disposed on the side of the pressure chambers reverse to the side adjacent to the ejection ports and includes a plurality of ceramic thin plates arranged to overlap each other, the laminated body being formed with a common liquid chamber which supplies the liquid to the pressure chambers, and electrical wires which supply drive signals to the piezoelectric elements and are formed so as to rise upward in a direction substantially perpendicular to a surface on which the piezoelectric elements are disposed.

According to the present invention, the common liquid chamber formed in the laminated body composed by the plurality of ceramic thin sheets arranged to overlap each other has improved rigidity, good resistance to liquid, and enhanced refilling properties. Furthermore, high-density wiring installation can be achieved by means of the electrical wires formed in the laminated body, and high-density arrangement of the ejection ports can be achieved.

Preferably, the laminated body is composed by alternately arranging first ceramic thin plates having a plurality of first cavities formed in a long and thin band shape between a plurality of first beam sections formed in a first direction, and second ceramic thin plates having a plurality of second cavities formed in a long and thin band shape between a plurality of second beam sections formed in a second direction different from the first direction, to overlap each other; the common liquid chamber is constituted by a space formed by the first cavities and the second cavities; and the electrical wires are formed in overlapping regions between the first beam sections formed in the first ceramic thin plates and the second beam sections formed in the second ceramic thin plates.

According to this aspect of the present invention, it is possible to form the common liquid chamber through the whole of the liquid ejection head. Furthermore, the height of the common liquid chamber can be raised by increasing the number of ceramic thin plates arranged to overlap each other, a large-capacity common liquid chamber can be constructed readily, and refilling performance can be enhanced yet further.

Alternatively, it is also preferable that the laminated body is composed by arranging a plurality of ceramic thin plates having a plurality of cavities formed in a long and thin band shape between a plurality of beam sections formed in a prescribed direction, to overlap each other, in such a manner that the cavities are mutually superimposed; the common liquid chamber is constituted by a space formed by superimposition of the cavities; and the electrical wires are formed in the beam sections formed in the ceramic thin plates. According to this aspect of the present invention, since the flow channel resistance acting on the liquid inside the common liquid chamber is reduced, then air bubbles become less liable to be trapped and refilling performance is enhanced yet further.

Preferably, the electrical wires having side faces covered with ceramic are erected in column form in a space constituting the common liquid chamber of the laminated body. According to this aspect of the present invention, since the volume of the common liquid chamber is increased, while the flow channel resistance acting on the liquid in the common liquid chamber is reduced, then refilling performance is enhanced yet further.

Preferably, the electrical wires are formed so as to rise upward from the piezoelectric elements or vicinities of the piezoelectric elements. According to this aspect of the present invention, the density of the ejection ports can be increased.

Preferably, the ejection ports are arranged in a two-dimensional array; and the electrical wires are arranged two-dimensionally on the surface on which the piezoelectric elements are disposed. According to this aspect of the present invention, it is possible to achieve an even higher density of the ejection ports, and furthermore, space for positioning the wire members is ensured and the flow channel resistance acting on the liquid inside the common liquid chamber is reduced.

In order to attain the aforementioned object, the present invention is also directed to an image forming apparatus, comprising the above-described liquid ejection head. According to the present invention, images of even higher quality can be formed by means of a liquid ejection head having higher density.

In order to attain the aforementioned object, the present invention is also directed to a method of manufacturing a liquid ejection head, comprising: a plurality of ejection ports which eject liquid; a plurality of pressure chambers which are connected respectively to the ejection ports; a plurality of piezoelectric elements which are disposed on a side of the pressure chambers reverse to a side adjacent to the ejection ports and respectively deform the pressure chambers; and a laminated body which is disposed on the side of the pressure chambers reverse to the side adjacent to the ejection ports and includes a plurality of ceramic thin plates arranged to overlap each other, the laminated body being formed with a common liquid chamber which supplies the liquid to the pressure chambers, and electrical wires which supply drive signals to the piezoelectric elements and are formed so as to rise upward in a direction substantially perpendicular to a surface on which the piezoelectric elements are disposed, the method comprising the steps of: forming cavities in green sheets to be the ceramic thin plates; forming hole sections for the electrical wires, in the green sheets; filling electrode material into the hole sections; arranging the green sheets having the hole sections filled with the electrode material, to overlap each other; and calcining the arranged green sheets to form the ceramic thin plates.

According to the present invention, it is possible to perform a calcining step on the basis of a batch process, which is suitable for mass production of liquid ejection heads.

Preferably, the method further comprises the step of, before the calcining step, filling binder resin into the cavities formed in the green sheets. According to this aspect of the present invention, the stability of the shape of the green sheets is improved.

According to the present invention, the common liquid chamber formed in the laminated body composed by the plurality of ceramic thin sheets arranged to overlap each other has improved rigidity, good resistance to liquid, and enhanced refilling properties. Furthermore, high-density wiring installation can be achieved by means of the electrical wires formed in the laminated body, and high-density arrangement of the ejection ports can be achieved.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment

Firstly, a first embodiment of the present invention will be described.

Figure 1:
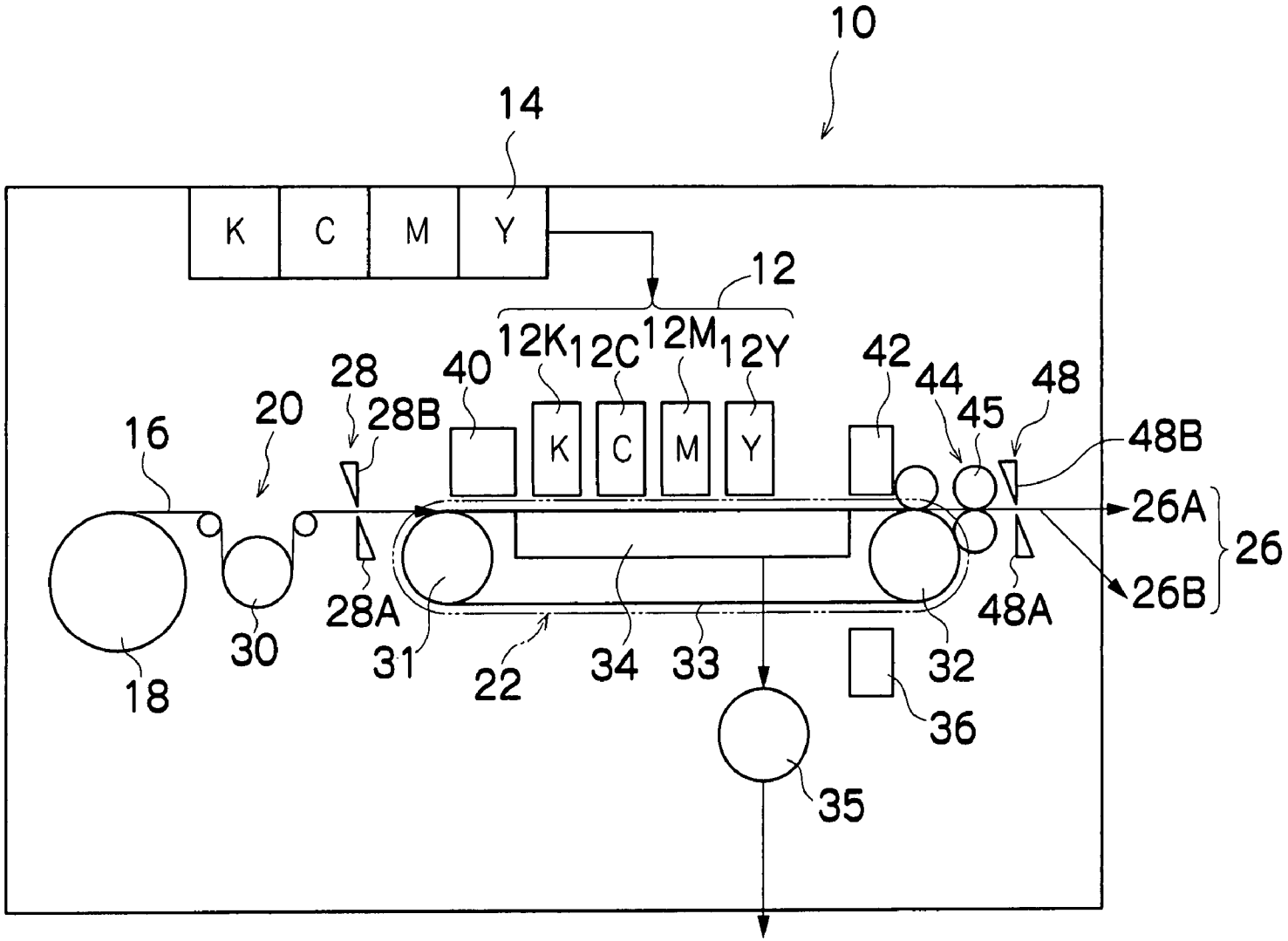
FIG. 1 is a general schematic drawing of an inkjet recording apparatus.

FIG. 1 is a general schematic drawing showing an approximate view of a first embodiment of an inkjet recording apparatus forming an image forming apparatus having a liquid ejection head relating to the present invention. As shown in FIG. 1, the inkjet recording apparatus 10 comprises: a printing unit 12 having a plurality of print heads (liquid ejection heads) 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16 supplied from the paper supply unit 18; a suction belt conveyance unit 22 disposed facing the nozzle face (ink droplet ejection face) of the print unit 12, for conveying the recording paper 16 while keeping the recording paper 16 flat; and a paper output unit 26 for outputting printed recording paper (printed matter) to the exterior.

In FIG. 1, a magazine for rolled paper (continuous paper) is shown as an embodiment of the paper supply unit 18; however, a plurality of magazines with papers of different paper width and quality may be jointly provided. Moreover, papers may be supplied in cassettes that contain cut papers loaded in layers and that are used jointly or in lieu of magazines for rolled papers.

In the case of a configuration in which roll paper is used, a cutter 28 is provided as shown in FIG. 1, and the roll paper is cut to a desired size by the cutter 28. The cutter 28 has a stationary blade 28A, of which length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 forms a plane (flat plane).

The belt 33 has a width that is greater than the width of the recording paper 16, and a plurality of suction apertures (not shown) are formed on the belt surface. A suction chamber 34 is disposed in a position facing the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
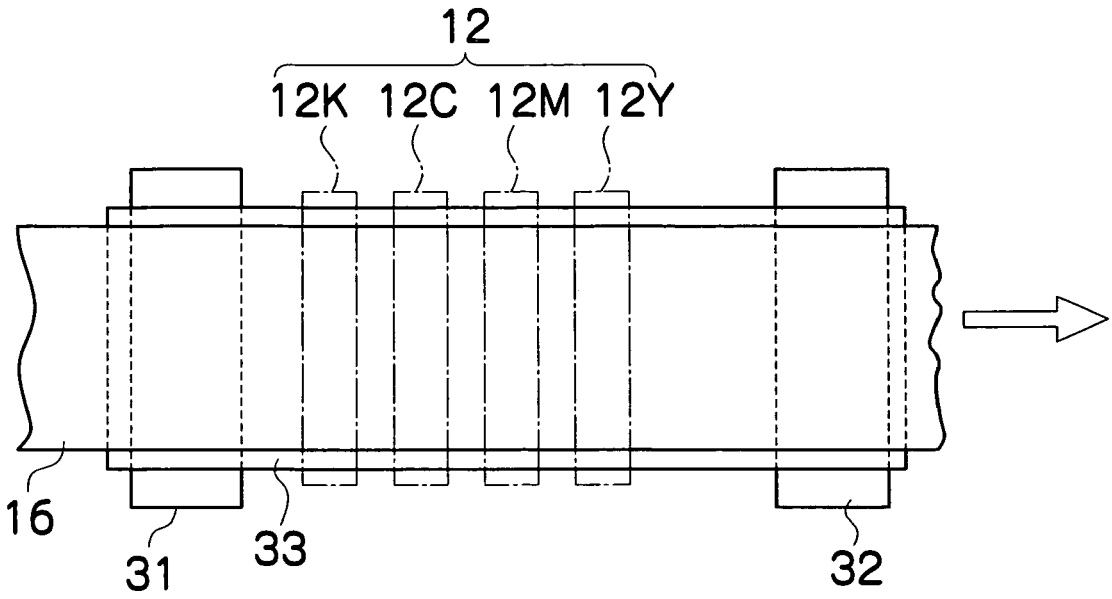
FIG. 2 is a plan view of the principal part of the peripheral area of a print unit in the inkjet recording apparatus shown in FIG. 1.

The print unit 12 is a so-called "full line head" in which a line head having a length corresponding to the maximum paper width is arranged in a direction (main scanning direction) that is perpendicular to the paper conveyance direction (sub-scanning direction) (see FIG. 2).

As shown in FIG. 2, the print heads 12K, 12C, 12M and 12Y are constituted by line heads in which a plurality of ink ejection ports (nozzles) are arranged through a length exceeding at least one edge of the maximum size recording paper 16 intended for use with the inkjet recording apparatus 10.

The print heads 12K, 12C, 12M, 12Y corresponding to respective ink colors are disposed in the order, black (K), cyan (C), magenta (M) and yellow (Y), from the upstream side (left-hand side in FIG. 1), following the direction of conveyance of the recording paper 16 (the paper conveyance direction). A color print can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the paper conveyance direction (sub-scanning direction) just once (in other words, by means of a single sub-scan). Higher-speed printing is thereby made possible and productivity can be improved in comparison with a shuttle type head configuration in which a recording head moves reciprocally in a direction (main scanning direction) which is perpendicular to the paper conveyance direction (sub-scanning direction).

Although the configuration with the KCMY four standard colors is described in the present embodiment, combinations of the ink colors and the number of colors are not limited to those. Light inks or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device, an alarm sound generator, or the like) for warning when the remaining amount of any ink is low, and has a mechanism for preventing loading errors among the colors.

A post-drying unit 42 is disposed following the print heads 12K, 12C, 12M, and 12Y. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown, the paper output unit 26A for the target prints is provided with a sorter for collecting prints according to print orders.

Next, the arrangement of nozzles (ejection ports) in the print head (liquid ejection head) will be described. The print heads 12K, 12M, 12C and 12Y provided for the respective ink colors have the same structure, and a reference numeral 50 is hereinafter designated to a representative embodiment of these print heads.

Figure 3:
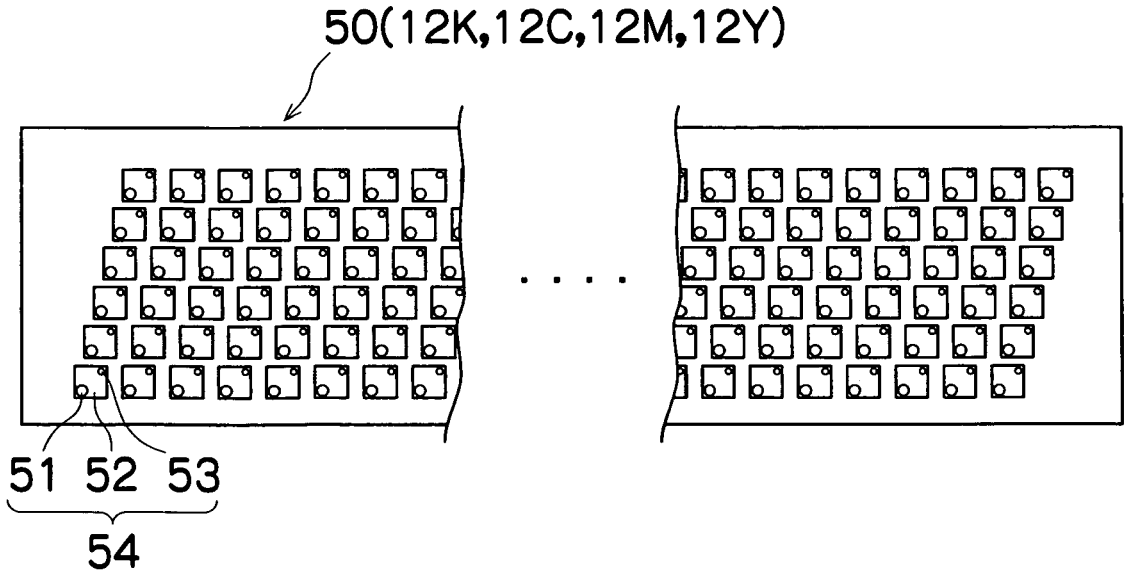
FIG. 3 is a plan perspective diagram showing an embodiment of the structure of a print head.

FIG. 3 is a plan view perspective diagram of the print head 50. As shown in FIG. 3, the print head 50 according to the present embodiment achieves a high density arrangement of nozzles 51 by using a two-dimensional staggered matrix array of pressure chamber units 54, each constituted by the nozzle 51 for ejecting ink as ink droplets, a pressure chamber 52 for applying pressure to the ink in order to eject ink, and an ink supply port 53 for supplying ink to the pressure chamber 52 from a common liquid chamber 70 (not shown in FIG. 3 but shown in FIG. 6).

In the embodiment shown in FIG. 3, the pressure chambers 52 each have an approximately square planar shape when viewed from above, but the planar shape of the pressure chambers 52 is not limited to a square shape. As shown in FIG. 3, the nozzle 51 is formed at one end of the diagonal of each pressure chamber 52, and an ink supply port 53 is provided at the other end thereof.

Figure 4:
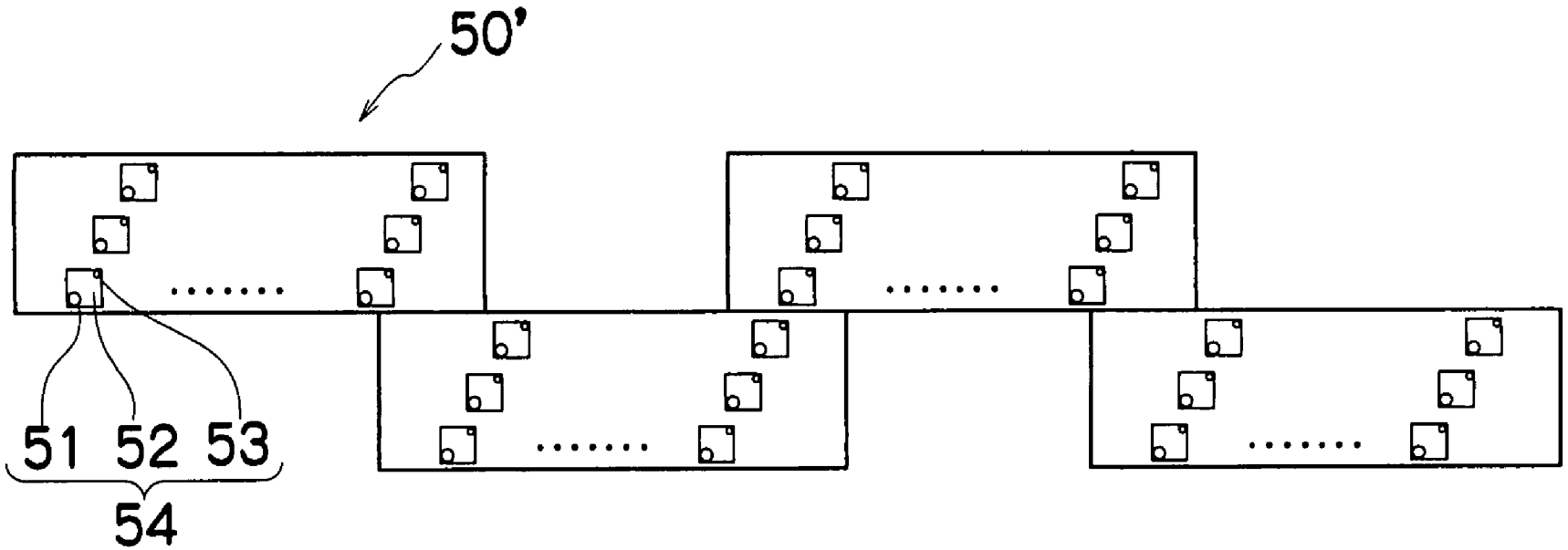
FIG. 4 is a plan view showing a further embodiment of a print head.

Moreover, FIG. 4 is a plan view perspective diagram showing a further embodiment of the structure of a print head. As shown in FIG. 4, one long full line head may be constituted by combining a plurality of short heads 50' arranged in a two-dimensional staggered array, in such a manner that the combined length of this plurality of short heads 50' corresponds to the full width of the print medium.

Figure 5:
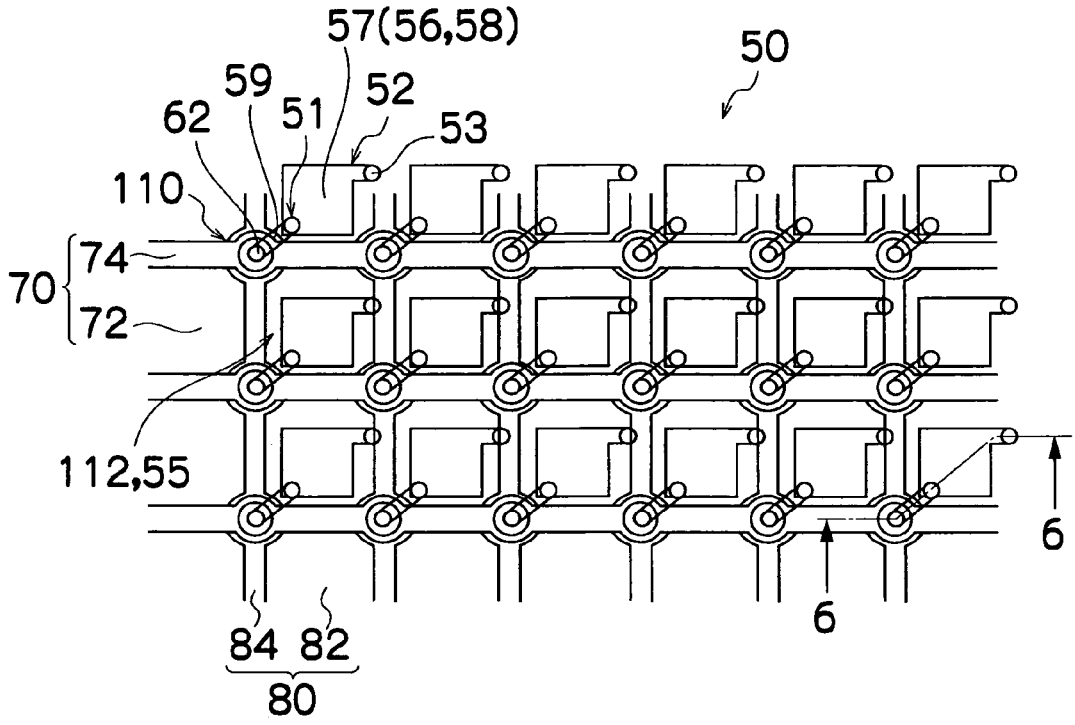
FIG. 5 is a plan view perspective diagram showing a partial enlarged view of the print head according to the first embodiment.

FIG. 5 is a plan view perspective diagram showing an enlarged view of a portion of a print head 50 according to the present embodiment. The print head 50 according to the present embodiment is formed by arranging a plurality of plate members to overlap each other. The nozzles 51 and ink supply ports 53 are provided respectively in the pressure chambers 52 having a substantially square shape, and as described above, these elements are arranged two-dimensionally in a staggered matrix configuration.

The cross-sectional composition of the print head 50 is described in detail below with reference to FIG. 6, and a diaphragm 56 which also serves as a common electrode is provided in such a manner that it covers all of the pressure chambers 52 provided in a matrix configuration. Furthermore, piezoelectric elements 58 comprising individual electrodes 57 are formed in accordance with the shape of the pressure chambers 52, at positions on the diaphragm 56 corresponding to the pressure chambers 52.

Furthermore, a wire is extracted to the outer side of each pressure chamber 52 (individual electrode 57), from the end section of the individual electrode 57 on the side adjacent to the nozzle 51, and an electrode pad 59 forming an electrode connecting section is formed thereby. Column-shaped electrical wires (electrical columns) 62 are formed on these electrode pads 59 so as to rise upward in a direction substantially perpendicular to the diaphragm 56 on which the piezoelectric elements 58 are disposed.

In the print head 50 according to the present embodiment, a first cavity plate 70 (first ceramic thin plate) in which a plurality of long and thin cavities 72 (first cavities) are formed in a band shape in the lateral direction (first direction), and a second cavity plate 80 (second ceramic thin plate) in which a plurality of long and thin cavities 82 (second cavities) are formed in a band shape in the vertical direction (second direction), are arranged to overlap each other in alternating fashion on a diaphragm 56. As described below, these cavity plates 70 and 80 are ceramic thin plates (ceramic sheets) formed by sintering ceramic green sheets.

Beam sections 74 (first beam sections) formed between the cavities of the first cavity plate 70, and beam sections 84 (second beam sections) formed between the cavities 82 of the second cavity plate 80 are respectively disposed in positions which correspond to the pressure chambers 52. The beam sections 74 and 84 form a perpendicularly intersecting lattice shape, and column-shaped electrical wires 62 are formed at the beam intersection regions 110 where the beam sections intersect when they are mutually superimposed.

Furthermore, the spaces formed by the cavities 72 and 82 are formed over the whole of the print head 50, and they constitute a common liquid chamber 55, which stores ink to be supplied to the respective pressure chambers 52. The respective cavity intersection regions 112 formed by the intersections of the respective cavities 72 and 82 when mutually superimposed correspond respectively to the positions at which the pressure chambers 52 are formed, and mutually adjacent cavity intersection regions 112 are linked together respectively by means of the spaces formed between the beam sections 74 and 84, which are formed in a lattice configuration. Thereby, a single space corresponding to the common liquid chamber 55 is formed throughout the whole of the print head 50.

Figure 6:
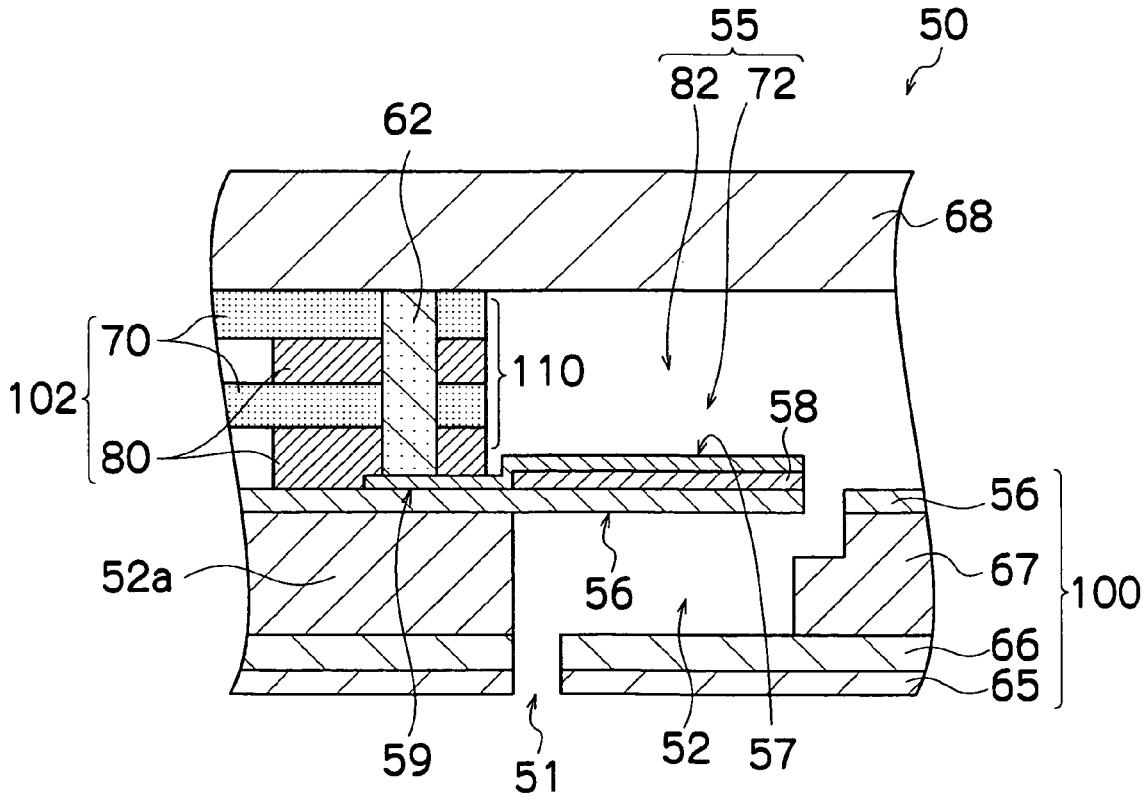
FIG. 6 is a cross-sectional diagram along line 6-6 in FIG. 5.

To provide a more detailed description, FIG. 6 shows a cross-section along line 6-6 in FIG. 5.

As shown in FIG. 6, the print head 50 according to the present embodiment is chiefly constituted by a pressure generation unit 100, a flow channel unit 102 (laminated body), and a multi-layer flexible cable 68.

The pressure generation unit 100 is composed by arranging a nozzle plate 65 in which the nozzles 51 are formed, a spacer plate 66, a pressure chamber plate 67 in which the pressure chambers 52 are formed, and the diaphragm 56 which also serves as the common electrode, to overlap each other. The diaphragm 56 forming the upper surface of the pressure chambers 52 is formed with the ink supply ports 53 for supplying ink to the respective pressure chambers 52 from the common liquid chamber 55. Furthermore, the piezoelectric elements 58 provided with the individual electrodes 57 are formed on the diaphragm 56 (on the surface reverse to the surface adjacent to the pressure chambers 52), at positions corresponding to the pressure chambers 52. A wire is extracted from the end section of each individual electrode 57 to a position corresponding to the outside of the pressure chamber 52 (the pressure chamber wall 52*a*), thereby forming an electrode pad 59. Although not shown in the drawings, an insulating layer is formed between the diaphragm 56 and the electrode pads 59.

The flow channel unit 102 is provided on top of the diaphragm 56 of the pressure generation unit 100. The flow channel unit 102 is formed by alternately arranging first cavity plates 70 and second cavity plates 80. The column-shaped electrical wires (electrical columns) 62 are provided in the beam intersection regions 110 where the beam sections 74 of the first cavity plates 70 (see FIG. 5) and the beam sections 84 of the second cavity plates 80 (see FIG. 5) intersect when mutually superimposed, these electrical wires rising up in a direction substantially perpendicular to the diaphragm 56, from the electrode pads 59 disposed at positions corresponding to the pressure chamber walls 52*a*. The other ends of the electrical wires 62 are connected to the wires inside the multiple-layer flexible cable 68 (not shown), which forms a wiring substrate disposed on top of the flow channel unit 102.

Moreover, the spaces formed by the cavities 72 and 82 of the cavity plates 70 and 80 create the common liquid chamber 55, which accumulates ink to be supplied to the respective pressure chambers 52. Ink is accumulated in the common liquid chamber 55. Preferably, an insulating and protective film (not shown) is formed over all of the portions which make contact with the ink.

Figure 7A:
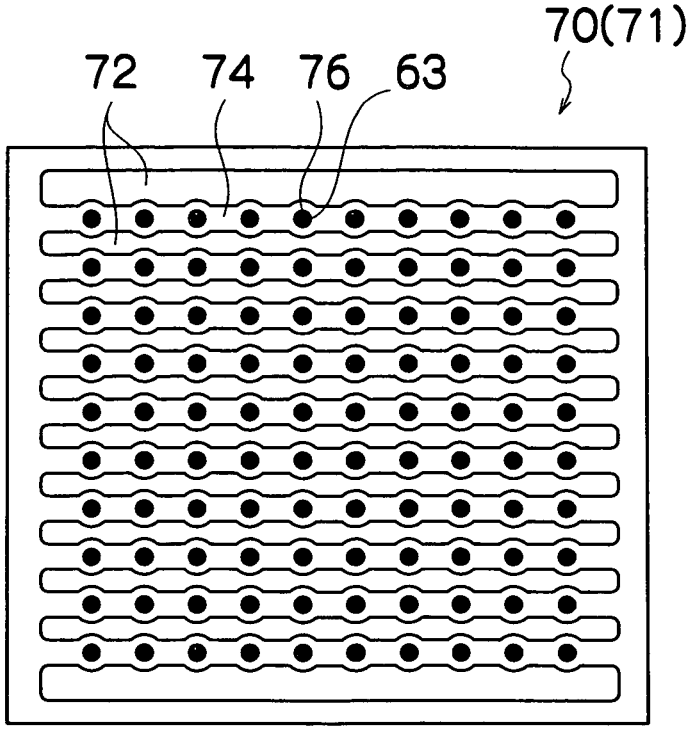
FIGS. 7A and 7B are plan diagrams showing first and second cavity plates (green sheets with cavities)
Figure 7B:
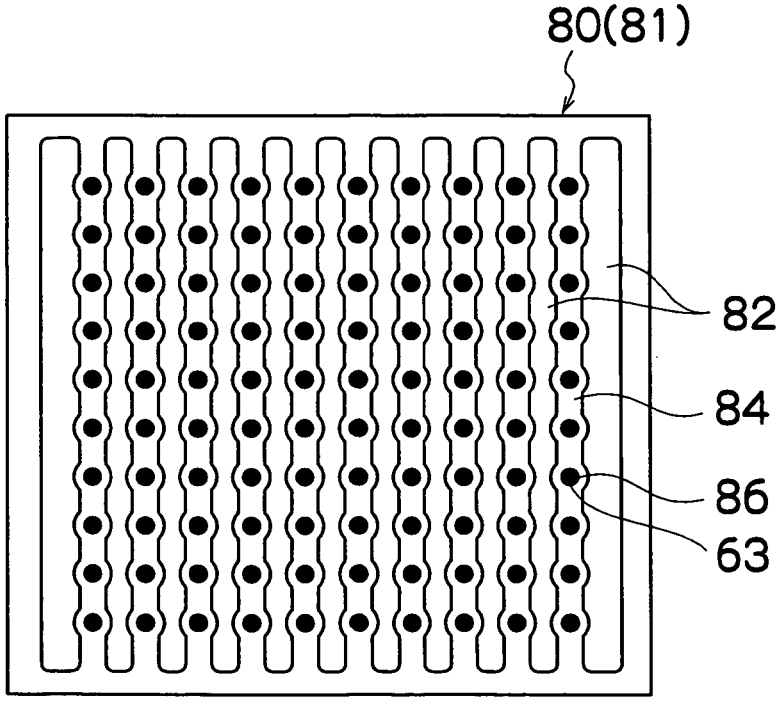

FIG. 7A is a plan diagram of the first cavity plate 70, and FIG. 7B is a plan diagram of the second cavity plate 80.

As shown in FIG. 7A, the first cavity plate 70 is formed with the plurality of band-shaped cavities 72, which are long and thin in the lateral direction. The beam sections 74, which are long and thin in the lateral direction, are formed between the cavities 72, and the respective beam sections 74 are connected together at either end thereof. As stated previously, when the first cavity plates 70 are arranged, the cavities 72 form a portion of the common liquid chamber 55. Hole sections (vias) 76 for forming electrical wires 62 are formed at regular intervals in the beam sections 74. The portions of the beam sections 74 where the hole sections 76 for the electrical wires are formed are shaped to have an enlarged external dimension, in accordance with the shape of the hole sections 76.

Furthermore, as shown in FIG. 7B, the second cavity plate 80 is formed with the plurality of band-shaped cavities 82, which are long and thin in the longitudinal direction. The beam sections 84, which are long and thin in the longitudinal direction, are formed between the cavities 82, and the respective beam sections 84 are connected together at either end thereof. As stated previously, when the second cavity plates 80 are arranged, the cavities 82 form a portion of the common liquid chamber 55. Hole sections (vias) 86 for forming electrical wires 62 are formed at regular intervals in the beam sections 84. The portions of the beam sections 84 where the hole sections 86 for the electrical wires are formed are shaped to have an enlarged external dimension, in accordance with the shape of the hole sections 86.

Figure 8:
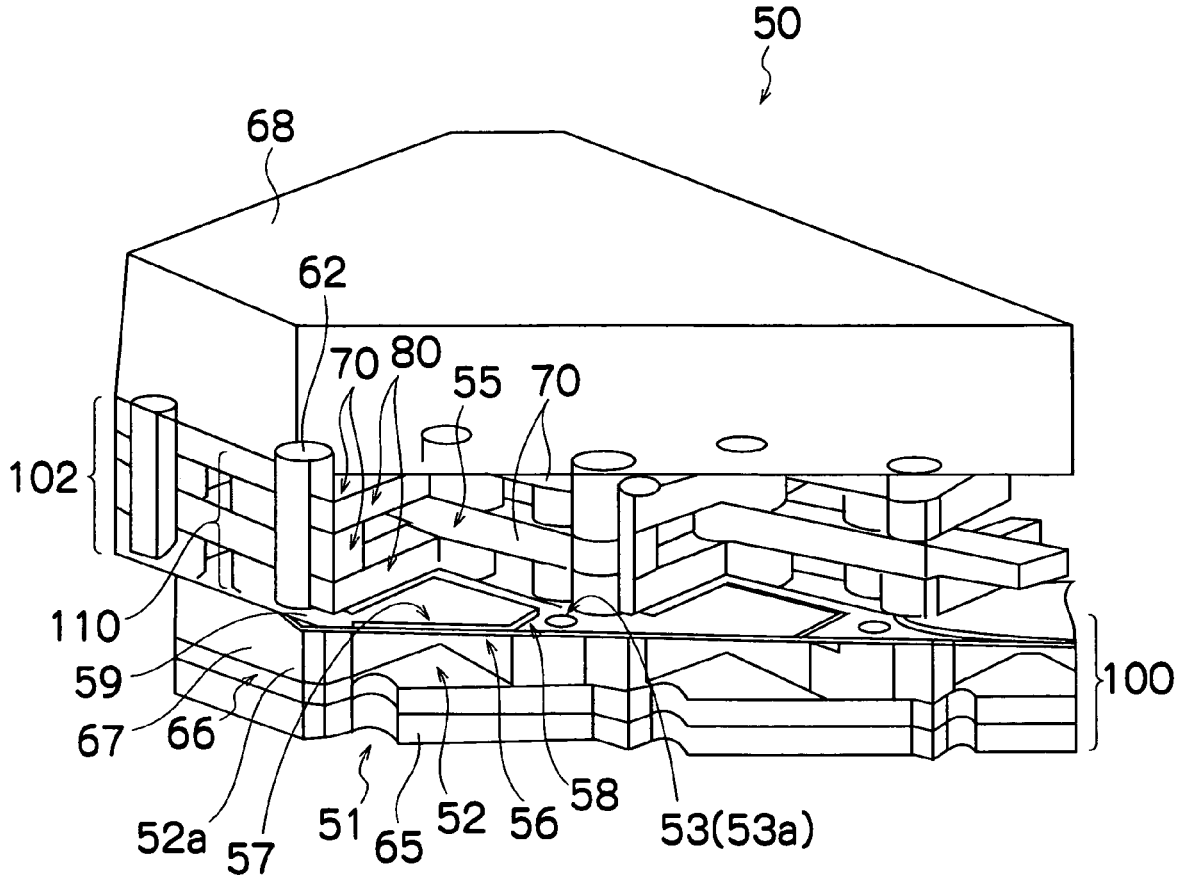
FIG. 8 is an oblique diagram showing a partial cross-section of a print head 50 according to the first embodiment.

FIG. 8 is an oblique diagram showing a partial cross-section of the print head 50 according to the present embodiment. As shown in FIG. 8, the print head 50 comprises: the pressure chamber generation unit 100 composed by arranging the nozzle plate 65 formed with the nozzles 51, the spacer plate 66, the pressure chamber plate 62 formed with the pressure chambers 52, and the piezoelectric elements 58 comprising the individual electrodes 57 disposed at positions corresponding to the pressure chambers 52; the flow channel unit 102 composed by alternately arranging the cavity plates 70 and 80 to overlap each other; and the multiple-layer flexible cable 68.

Inside the flow channel unit 102 disposed above the diaphragm 56 of the pressure generation unit 100, the beam sections 74 and 84 of the cavity plates 70 and 80 are mutually intersecting, forming a lattice pattern, and a single space is created throughout the whole of the print head 50. This space forms the common liquid chamber 55. The respective pressure chambers 52 are connected to the common liquid chamber 55 through the ink supply ports 53 formed in the diaphragm 56. Furthermore, in the beam intersection regions 110 where the overlapping beam sections 74 and 84 are mutually superimposed, column-shaped electrical wires (electrical columns) 62 are provided so as to rise up from the electrode pads 59 in a direction substantially perpendicular to the diaphragm 56 on which the piezoelectric elements 58 are provided.

The multi-layer flexible cable 68 is disposed on the flow channel unit 102 and the electrical wires 62 are connected to the respective wires (not shown) inside the multi-layer flexible cable 68.

Next, a method of manufacturing a print head 50 according to the present invention will be described.

Firstly, as shown in FIGS. 7A and 7B, a plurality of ceramic green sheets are prepared, and the plurality of cavities 72 which are thin and long in the lateral direction, or the plurality of cavities 82 which are thin and long in the longitudinal direction are processed in band shapes, in the respective green sheets, thereby fabricating first green sheets with cavities 71 and second green sheets with cavities 81. By processing the cavities 72 (or 82), the beam sections 74 (or 84) are formed between the respective cavities 72 (or 82). As a material for the ceramic, zirconia, alumina, aluminum nitride, silicon carbide, or the like, is used.

Next, as shown in FIGS. 7A and 7B, the hole sections 76 and 86 for the electrical wires are pierced at regular intervals in the respective beam sections 74 and 84 of the green sheets with cavities 71 and 81. Electrode material 63 is then filled into the hole sections 76 and 86. Gold, silver, copper, nickel, platinum, tungsten, or the like, is used as the electrode material 63. Furthermore, as in the third embodiment described below, desirably, a binder resin is filled into the cavities 72 and 82 of the green sheets with cavities 71 and 81, thereby stabilizing the shape of the green sheets 71 and 81.

Figure 9:
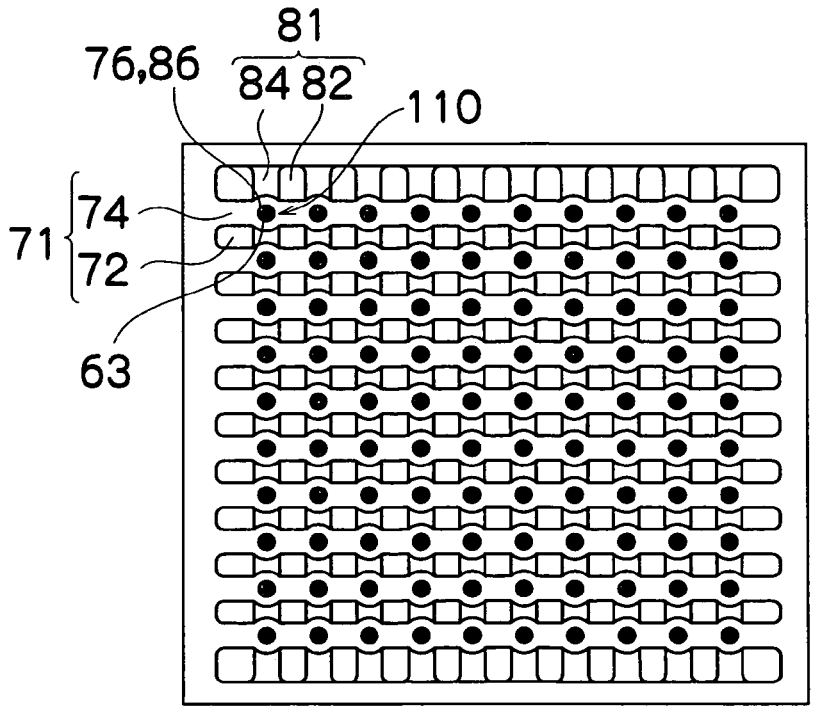
FIG. 9 is a plan diagram of a case where first and second green sheets with cavities are alternately arranged to overlap each other.

Thereupon, the first green sheets with cavities 71 and the second green sheets with cavities 81 are alternately arranged to overlap each other. FIG. 9 is a plan diagram of the alternately arranged green sheets with cavities 71 and 81. As shown in FIG. 9, the green sheets with cavities 71 and 81 are arranged to overlap each other in such a manner that the hole sections 76 and 86 filled with the electrode material 63 are disposed at the beam intersection regions 110 where the beam sections 74 and 84 of the green sheets with cavities 71 and 81 intersect and are mutually superimposed.

Figure 10:
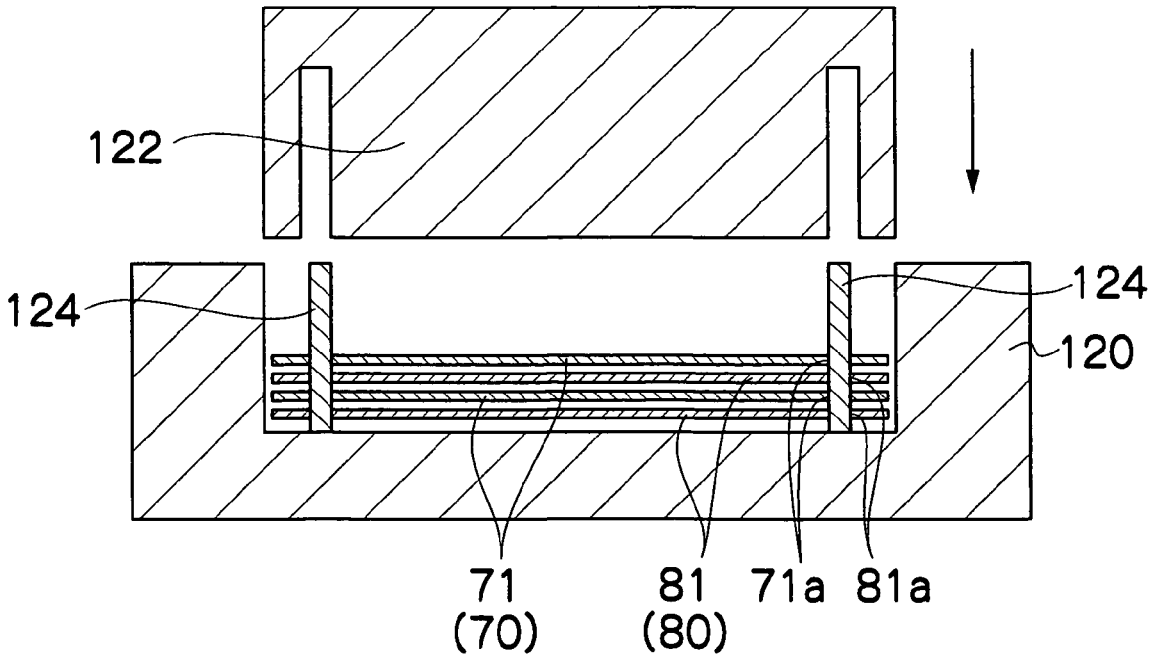
FIG. 10 is an illustrative diagram showing one embodiment of a method of applying pressure to green sheets with cavities.

Next, the green sheets with cavities 71 and 81 arranged to overlap each other are calcined simultaneously while applying pressure in the direction of lamination. FIG. 10 is an illustrative diagram showing one embodiment of a method of applying pressure to the green sheets with cavities 71 and 81. If this pressurization method is used, then as shown in FIG. 10, positioning holes 71*a* and 81*a* are formed previously at either end of the green sheets with cavities 71 and 81 in the lengthwise direction thereof. Positioning is carried out by passing positioning pins 124 of a lower mold 120 through the positioning holes 71*a* and 81*a* in the green sheets with cavities 71 and 81 arranged to overlap each other, and pressure is applied to the green sheets with cavities 71 and 81 in the direction of lamination thereof (in the direction of the arrow in FIG. 10), by moving an upper mold 122 in the direction shown by the arrow in FIG. 10. The green sheets with cavities 71 and 81 arranged to overlap each other are calcined simultaneously. Thereby, column-shaped electrical wires 62 are formed of the electrode material 63 filled in the hole sections 76 and 86 for electrical wiring. This calcining step can be performed by batch processing, and is therefore suitable for mass-production of print heads 50. Furthermore, since the green sheets with cavities 71 and 81 are fixed in position at the respective ends thereof in the lengthwise direction and are then calcined while applying pressure in the direction of lamination, then thermal contraction of the green sheets with cavities 71 and 81 in the lengthwise direction during calcining is prevented. In this way, a composition of alternately arranged first cavity plates 70 (first ceramic thin plates) and second cavity plates 80 (second ceramic thin plates), which are formed by the sintered green sheets with cavities 71 and 81, is achieved, and the flow channel unit 102 (laminated body) formed internally with the common liquid chamber 55 and the electrical wires 62 is thus fabricated.

As shown in FIG. 6, the flow channel unit 102 is then bonded onto the pressure generation unit 100 formed by means of a commonly known method, and by subsequently bonding the multiple-layer flexible cable 68 onto the flow channel unit 102, the print head 50 according to the present embodiment can be manufactured.

In the present embodiment, the flow channel unit 102 provided on the diaphragm 56 of the pressure generation unit 100 is composed by alternately arranging the first cavity plates 70 (first ceramic thin sheets) having the plurality of cavities 72 (first cavities) which are thin and long in the lateral direction (first direction), and the second cavity plates 80 (second ceramic thin sheets) having the plurality of cavities 82 (second cavities) which are thin and long in the longitudinal direction (second direction), to overlap each other. The common liquid chamber 55 which supplies ink to the respective pressure chambers 52 is formed, and the column-shaped electrical wires (electrical columns) 62 are formed rising up in a direction substantially perpendicular to the diaphragm 56 on which the piezoelectric elements 58 are provided. The common liquid chamber 55 formed in the flow channel unit composed by arranging ceramic thin sheets to overlap each other in this way has improved rigidity, good resistance to liquid, and enhanced refilling properties. Furthermore, the dimensional accuracy is good and heat radiation effects are also obtained. Moreover, the column-shaped electrical wires 62 formed in the flow channel unit 102 can be installed at high-density inside the multi-layer flexible cable 68 on the flow channel unit 102, and therefore, high-density arrangement of the nozzles 51 can be achieved.

Furthermore, in the present embodiment, it is possible to form the common liquid chamber 55 throughout the whole of the print head 50. Moreover, by increasing the number of sheets of the cavity plates 70 and 80 arranged to overlap each other, it is possible readily to increase the height of the common liquid chamber 55, and therefore a large-capacity common liquid chamber 55 can be formed easily and refilling properties can be enhanced yet further.

The directions in which the cavities are formed in the cavity plates are not limited to the longitudinal direction and lateral direction as in the present embodiment.

Second Embodiment

Next, a second embodiment of the present invention will be described.

Figure 11:
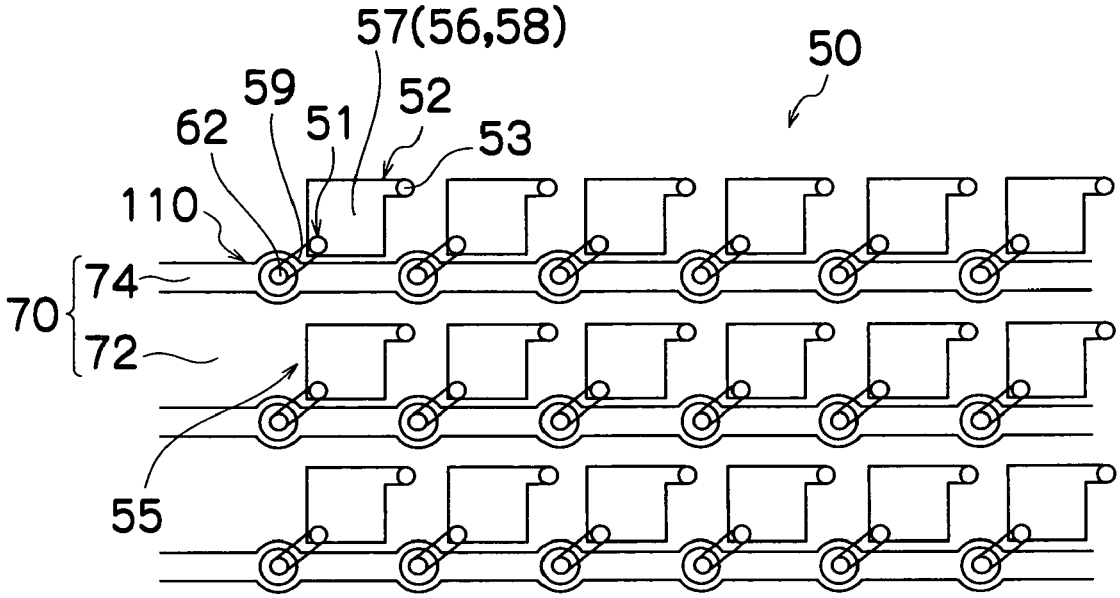
FIG. 11 is a plan view perspective diagram of a print head according to a second embodiment.

FIG. 11 is a plan view perspective diagram of a print head 50 according to the second embodiment. In the present embodiment, as shown in FIG. 11, a composition is adopted in which only a plurality of first cavity plates 70 having a plurality of cavities 72 which are thin and long in the lateral direction, are arranged to overlap each other. In this case, the first cavity plates 70 are arranged in such a manner that the beam sections 74 thereof are mutually superimposed, and hence tributary-shaped common liquid chambers 55 which are thin and long in the lateral direction are formed. It is also possible to arrange a plurality of second cavity plates 80 only, instead of the first cavity plates 70.

In the present embodiment, compared to the first embodiment, the fluid resistance acting on the ink in the common liquid chambers 55 is lower and therefore air bubbles are less liable to become trapped and refilling performance is further enhanced.

Third Embodiment

Next, a third embodiment of the present invention will be described.

Figure 12:
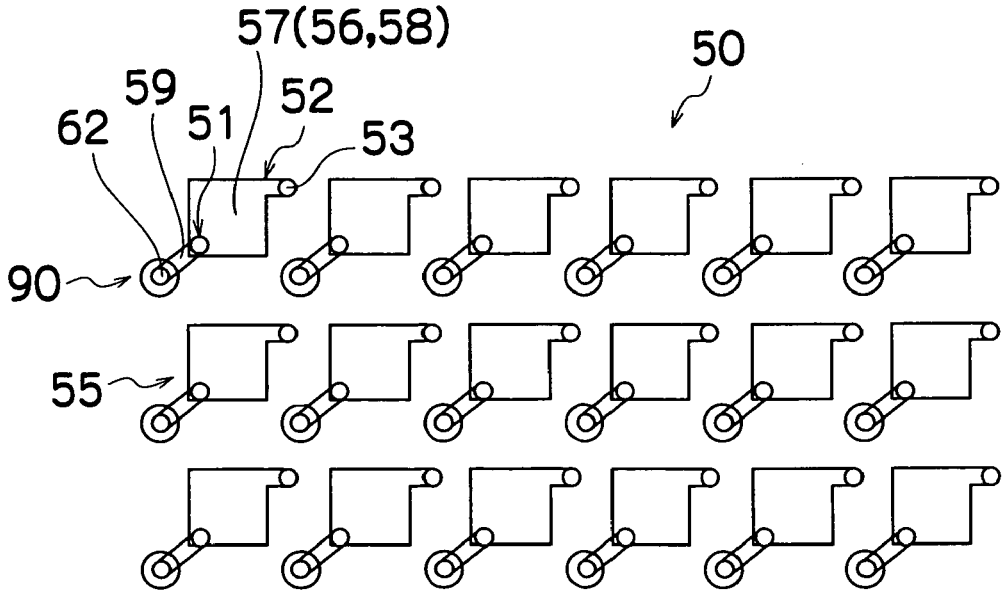
FIG. 12 is a plan view perspective diagram of a print head according to a third embodiment.

FIG. 12 is a plan view perspective diagram of a print head 50 according to the third embodiment. In the present embodiment, as shown in FIG. 12, there are no beam sections 74 and 84 (see FIGS. 5 and 11) in the lateral direction or longitudinal direction, as in the first and second embodiments, and column-shaped electrical wires 62 are formed by arranging a plurality of third cavity plates 90 to overlap each other.

Figure 13:
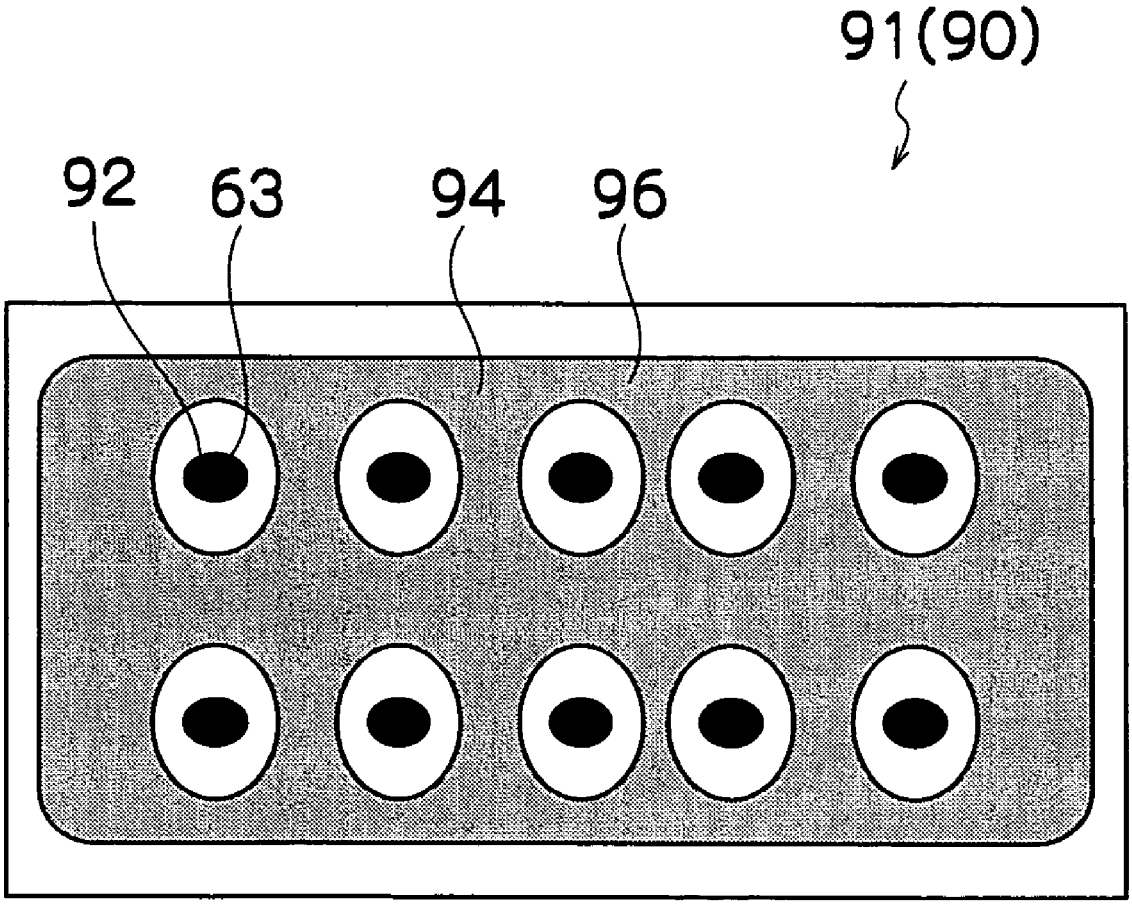
FIG. 13 is a plan diagram of a third green sheet with cavities.

FIG. 13 is a plan diagram of a third green sheet with cavities 91. The sintered third green sheet with cavities 91 (ceramic thin plate) corresponds to the third cavity plate 90. In order to manufacture the print head 50 according to the present embodiment, firstly, ceramic green sheets are prepared, and hole sections 92 for electrical wires are processed in each of the green sheets, in addition to which, a cavity 94 is processed in the whole of the green sheet so as to leave the end sections of the green sheet and the peripheral regions of the hole sections 92, thereby forming the third green sheet with cavities 91. Binder resin 96 is then filled into the cavity 94. The material of the binder resin 96 is similar to the binder material used for the green sheet and printing paste, and an acrylic-type resin, a polyurethane resin, a nylon-type resin, a polytetrafluoroethylene-type resin, a silicone-type resin, or the like, is used. By filling in binder resin 96, the stability of the shape of the third green sheet with cavities 91 is improved. Furthermore, the electrode material 63 is filled into the hole sections 92 for electrical wiring. A plurality of third green sheets with cavities 91 are arranged to overlap each other in such a manner that the hole sections 92 filled with the electrode material 63 are mutually superimposed, and they are then calcined simultaneously while applying pressure in the direction of lamination, by means of a similar method to that of the first embodiment. In so doing, the binder resin 96 filled in the cavities 94 evaporates, and therefore the common liquid chamber 55 is formed in the portion corresponding to the cavities 92. Furthermore, the column-shaped electrical wires 62 are formed by the electrode material 63 filled in the hole sections 92 for electrical wiring. In this way, it is possible to manufacture the flow channel unit 102 (laminated body) comprising the plurality of third cavity plates 90 arranged to overlap each other, which are formed by the sintered third green sheets with cavities 91 (ceramic thin plates). Similarly to the first embodiment, by then bonding the pressure generation unit 100 with the multiple-layer flexible cable 68, it is possible to manufacture the print head 50 according to the present embodiment.

In the present embodiment, only the electrical wires 62 having side faces covered with ceramic are erected in the form of columns in the space constituting the common liquid chamber 55 of the flow channel unit 102, and the beam sections 74 and 84 described in the first and second embodiments (see FIGS. 5 and 11) are not present in the common liquid chamber 55. Therefore, the flow resistance acting on the ink in the common liquid chamber 55 is even lower, and hence air bubbles become even less liable to be trapped and refilling performance is enhanced yet further. Moreover, the volume inside the common liquid chamber 55 increases and damping becomes easier to apply.

Furthermore, in the present embodiment, since the binder resin 96 is filled into the cavities 94 before calcining the third green sheets with cavities 91, then the stability of the shape of the third green sheets with cavities 91 is improved.

The liquid ejection head, image forming apparatus and method of manufacturing a liquid ejection head according to the present invention have been described in detail above, but the present invention is not limited to the aforementioned embodiments, and it is of course possible for improvements or modifications of various kinds to be implemented, within a range which does not deviate from the essence of the present invention.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a plurality of ejection ports which eject liquid;

a plurality of pressure chambers which are connected respectively to the ejection ports;

a plurality of piezoelectric elements which are disposed on a side of the pressure chambers reverse to a side adjacent to the ejection ports and respectively deform the pressure chambers; and a laminated body which is disposed on the side of the pressure chambers reverse to the side adjacent to the ejection ports and includes a plurality of ceramic thin plates arranged to overlap each other, the laminated body being formed with a common liquid chamber which supplies the liquid to the pressure chambers, and electrical wires which supply drive signals to the piezoelectric elements and are formed so as to rise upward in a direction substantially perpendicular to a surface on which the piezoelectric elements are disposed, wherein:

the laminated body is composed by alternately arranging first ceramic thin plates having a plurality of first cavities formed in a long and thin band shape between a plurality of first beam sections formed in a first direction, and second ceramic thin plates having a plurality of second cavities formed in a long and thin band shape between a plurality of second beam sections formed in a second direction perpendicular the first direction, to overlap each other;

the common liquid chamber is constituted by a space formed by the first cavities and the second cavities; and the electrical wires are formed in overlapping regions between the first beam sections formed in the first ceramic thin plates and the second beam sections formed in the second ceramic thin plates.

2. The liquid ejection head as defined in claim 1, wherein the electrical wires having side faces covered with ceramic are erected in column form in a space constituting the common liquid chamber of the laminated body.

3. The liquid ejection head as defined in claim 1, wherein the electrical wires are formed so as to rise upward from the piezoelectric elements.

4. The liquid ejection head as defined in claim 1, wherein the electrical wires are formed so as to rise upward from vicinities of the piezoelectric elements.

5. The liquid ejection head as defined in claim 1, wherein:

the ejection ports are arranged in a two-dimensional array; and the electrical wires are arranged two-dimensionally on the surface on which the piezoelectric elements are disposed.

6. An image forming apparatus, comprising the liquid ejection head as defined in claim 1.

7. A liquid ejection head, comprising:

a plurality of ejection ports which eject liquid;

a plurality of pressure chambers which are connected respectively to the ejection ports;

a plurality of piezoelectric elements which are disposed on a side of the pressure chambers reverse to a side adjacent to the ejection ports and respectively deform the pressure chambers; and a laminated body which is disposed on the side of the pressure chambers reverse to the side adjacent to the ejection ports and includes a plurality of ceramic thin plates arranged to overlap each other, the laminated body being formed with a common liquid chamber which supplies the liquid to the pressure chambers, and electrical wires which supply drive signals to the piezoelectric elements and are formed so as to rise upward in a direction substantially perpendicular to a surface on which the piezoelectric elements are disposed, wherein:

the laminated body is composed by arranging a plurality of ceramic thin plates having a plurality of cavities formed in a long and thin band shape between a plurality of beam sections formed in a prescribed direction, to overlap each other, in such a manner that the cavities are mutually superimposed;

the common liquid chamber is constituted by a space formed by superimposition of the cavities; and the electrical wires are formed in the beam sections formed in the ceramic thin plates.

8. The liquid ejection head as defined in claim 7, wherein the electrical wires having side faces covered with ceramic are erected in column in form in a space constituting the common liquid chamber of the laminated body.

9. The liquid ejection head as defined in claim 7, wherein the electrical wires are formed so as to rise upward from the piezoelectric elements.

10. The liquid ejection head as defined in claim 7, wherein the electrical wires are formed so as to rise upward from vicinities of the piezoelectric elements.

11. The liquid ejection head as defined in claim 7, wherein:

the ejection ports are arranged in a two-dimensional array; and the electrical wires are arranged two-dimensionally on the surface on which the piezoelectric elements are disposed.

12. An image forming apparatus, comprising the liquid ejection head as defined in claim 7.

* * * * *